United States Patent [19]

Barlow

[11] Patent Number: 4,701,056

[45] Date of Patent: Oct. 20, 1987

[54] TIMING MECHANISM

[75] Inventor: Gordon A. Barlow, Glenview, Ill.

[73] Assignee: Gordon Barlow Design, Skokie, Ill.

[21] Appl. No.: 7,590

[22] Filed: Jan. 28, 1987

[51] Int. Cl.[4] ..... G04F 1/04

[52] U.S. Cl. ..... 368/89; 368/93; 368/97

[58] Field of Search ..... 368/89–98; 84/404, 484; 278/148 R

[56] References Cited

U.S. PATENT DOCUMENTS

| | | | |
|---|---|---|---|
| 3,230,697 | 1/1966 | Ryan et al. | 368/94 |
| 3,522,701 | 8/1970 | Perry | 84/484 |
| 4,024,701 | 5/1977 | Corson | 368/94 |

*Primary Examiner*—Vit W. Miska

*Attorney, Agent, or Firm*—Kinzer, Plyer, Dorn, McEachran & Jambor

[57] ABSTRACT

A timing mechanism for use with a board game to indicate by sound and movement the time period allotted for answering a question or performing a turn or function. It includes a sphere such as a marble which rolls on a circular saucer having an upwardly facing conical plastic surface with a central depression. The central depression is sized to receive and hold the marble. An inclined ramp is formed at the periphery of the circular saucer and it has a width and incline sufficient to permit the marble to roll from the ramp onto the upwardly facing concave surface. A starting pad is located at the top of the inclined ramp on which to place the sphere to begin its downwardly roll. The starting pad is inclined so that the sphere and marble will not rest on the starting pad, but will immediately start its downwardly inclination when released. The circular saucer is formed of a thin-walled plastic which produces sound when the marble rolls down the ramp, circles the upwardly facing conical surface and ultimately comes to rest in the central semi-spherical depression.

2 Claims, 3 Drawing Figures

TIMING MECHANISM

BACKGROUND AND SUMMARY OF THE INVENTION

Games for children and adults which are called board games frequently require the use of a timing mechanism to indicate to the players the time allotted to make a move, answer a question or perform some other action. In addition to clearly signaling when the time period has expired, it is also desirable for the timing mechanism to indicate in a distinctive manner the approaching end of the allotted time. Frequently, this has the additional effect of heightening tension, especially for the player who is performing. Preferably, the timing mechanism should indicate both the passage of the time period and its expiration visually and acoustically. The timing mechanism should also be consistently accurate so that it does not favor one player over the other. Mechanically and electronically actuated timing mechanisms are available for this purpose, but these devices are generally too expensive to economically supply with an inexpensive board game.

Therefore, an object of this invention is a timing mechanism for a board game which clearly signals the end of a set period of time, both visually and acoustically.

Another object of this invention is a timing mechanism which indicates in a distinctive manner the approaching end of the time period.

Another object of this invention is a timing mechanism which indicates both visually and acoustically the running of the time period and its expiration.

Another object of this invention is a timing mechanism which is extremely consistent in its accuracy.

Another object of this invention is a timing mechanism which is extremely simple and inexpensive to manufacture.

Another object of this invention is a timing mechanism which can be used for other timing purposes.

Other objects of this invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
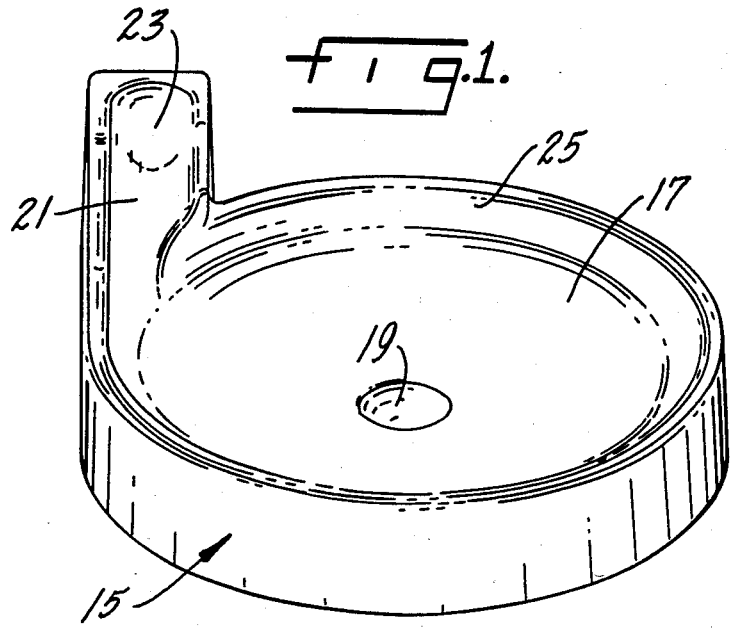
FIG. 1 is a perspective view of the timing mechanism of this invention, absent the marble.
Figure 2:
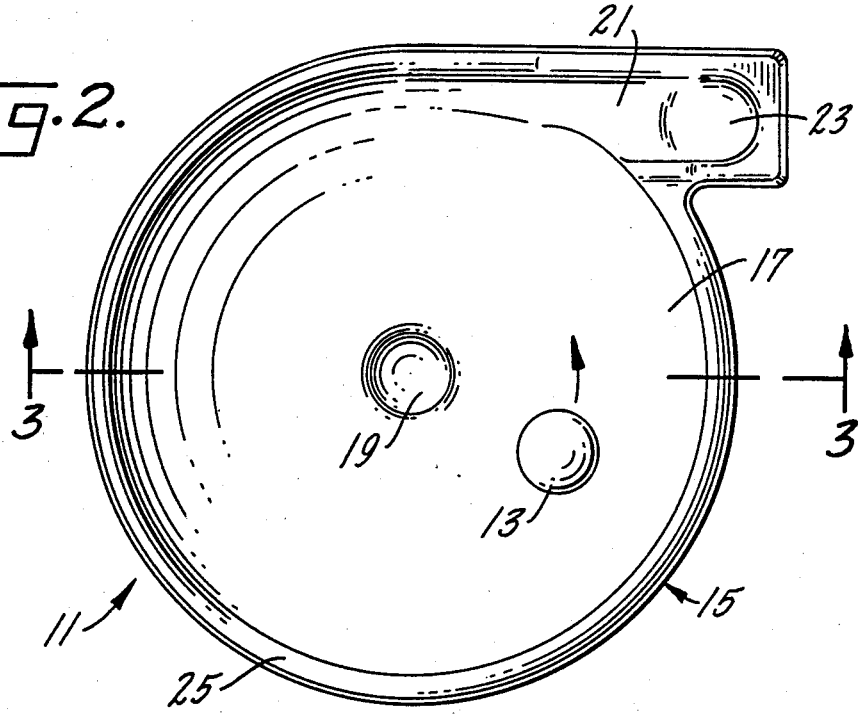
FIG. 2. is a top plan view of the timing mechanism of FIG. 1 showing the marble rolling during its timing movement.
Figure 3:
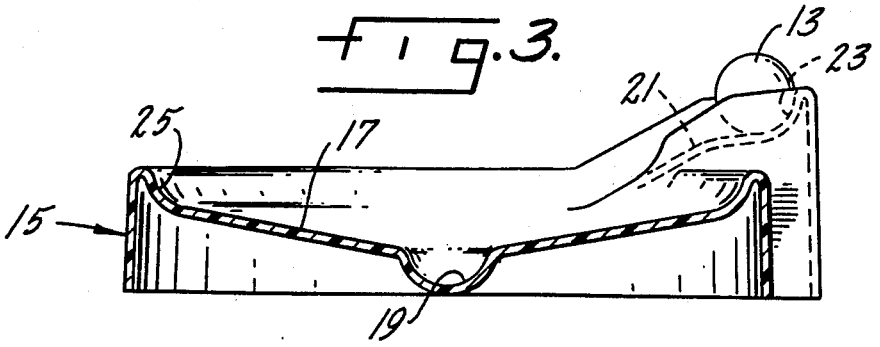
FIG. 3. is a cross sectional view taken along line 3—3 of FIG. 2 with the marble shown at its starting position.

The timing mechanism 11 of this invention is shown in its entirety in FIG. 2 of the drawings and includes a sphere 13 which can be a marble and a circular saucer 15 having an upwardly facing conical surface 17. A central semispherical depression 19 in the surface 17 is sized to receive and hold the sphere 13. An inclined ramp 21 is formed at the periphery of the circular saucer and extends tangentially to the conical surface 17. A slightly recessed starting pad 23 is located at the top of the inclined ramp and provides a place to position the sphere 13 to begin its downward roll. The starting pad is inclined so that the sphere will not rest on the pad but will start to roll as soon as it is released. The ramp 21 merges with a wall 25 which forms the periphery of the circular saucer 15. Thus, when the sphere 13 is released on the starting pad 23, it rolls down the inclined ramp 21 and around the periphery of the upwardly facing conical surface 17, following a somewhat spiral or helical path until it comes to rest in the central semi-spherical depression 19.

The circular saucer 15 is molded of thin walls of plastic of generally uniform thickness. As the sphere 13 rolls down the inclined ramp 21 and around the upwardly facing conical surface 17 of the circular saucer 15, it creates a sound. As the sphere 13 rocks back and forth prior to coming to rest in the central semi-spherical depression 19, it creates a distinctive rocking noise. Thus, the sphere 13 provides both a visual and audible indication that the time period for taking an action is running. As the sphere starts to settle in the central semi-spherical depression 19, it creates a distinctive clicking noise which lets the player know that its time for action is almost finished. This has a tendency to raise the tension and excitement of the game.

The timing mechanism of this invention provides for very accurate and repeatable time periods. Because of the design, it is only necessary to release the sphere and therefore the time is not changed for successive rolls of the sphere which could possibly occur if it were necessary to push the sphere to start it down the inclined ramp. Pushing the sphere at different speeds by different players could change the time it would take for the sphere to complete its timing cycle. Therefore, the time indicated by the rolling sphere of this timer is always the same.

I claim:

1. A timing mechanism for use with a board game to indicate by sound and movement the time period allotted for answering a question or performing a turn or function, including:

a sphere, a circular saucer having an upwardly facing conical plastic surface with a central depression, the central depression sized to receive and hold the sphere, an inclined ramp formed at the periphery of the circular saucer and having a width and incline sufficient to permit the sphere to roll from the ramp onto the upwardly facing conical surface, a starting pad at the top of the inclined ramp on which to place the sphere to begin its downwardly roll, and the circular saucer being formed of a thin-walled plastic which produces sound when the sphere rolls down the ramp, circles the upwardly facing conical surface and ultimately comes to rest in the central semi-spherical depression.

2. The timing mechanism of claim 1 in which the starting pad is inclined so that the sphere will not rest thereon, but will immediately start to roll down the inclined ramp when placed on the starting pad and released.

* * * * *